US009909589B2

(12) United States Patent
Kulkarni et al.

(10) Patent No.: US 9,909,589 B2
(45) Date of Patent: Mar. 6, 2018

(54) ROTARY MACHINE HAVING A VOLUTE ASSEMBLY-BEARING HOUSING JOINT WITH INTERLOCKING TEETH

(71) Applicant: General Electric Company, Schenectady, NY (US)

(72) Inventors: Raghav Shrikant Kulkarni, Bangalore (IN); Daniel Edward Loringer, Lawrence Park, PA (US); Ramesh Kotha Kumar, Bangalore (IN); Shrinivas Govind, Bangalore (IN)

(73) Assignee: General Electric Company, Schenectady, NY (US)

( * ) Notice: Subject to any disclaimer, the term of this patent is extended or adjusted under 35 U.S.C. 154(b) by 1298 days.

(21) Appl. No.: 14/155,489

(22) Filed: Jan. 15, 2014

(65) Prior Publication Data

US 2015/0198164 A1 Jul. 16, 2015

(51) Int. Cl.

| | |
|---|---|
| ***F01D 25/24*** | (2006.01) |
| ***F04D 29/62*** | (2006.01) |
| ***F04D 17/10*** | (2006.01) |

(52) U.S. Cl.

CPC ..... *F04D 17/10* (2013.01); *F04D 29/624* (2013.01)

(58) Field of Classification Search

CPC ..... F01D 25/243; F01D 25/246; F01D 25/28; F04D 29/403; F04D 29/42; F04D 29/62; F04D 29/624; F04D 29/628

USPC ..... 415/204, 214.1

See application file for complete search history.

(56) References Cited

U.S. PATENT DOCUMENTS

| | | | | |
|---|---|---|---|---|
| 3,004,700 | A | 8/1959 | Warren | |
| 5,536,144 | A | 7/1996 | Bednarz et al. | |
| 6,052,995 | A * | 4/2000 | Krimmer | F02B 37/16 123/564 |
| 6,793,468 | B2 * | 9/2004 | Ojima | F01D 25/166 148/434 |
| 6,928,816 | B2 * | 8/2005 | Leavesley | F01D 17/14 415/158 |
| 7,134,836 | B2 * | 11/2006 | Scherrer | F01D 11/005 415/112 |
| 7,832,775 | B2 * | 11/2010 | Regener | F02B 33/44 285/377 |
| 7,909,592 | B2 | 3/2011 | Yano et al. | |
| 8,152,489 | B2 * | 4/2012 | Shimizu | F01D 15/10 417/405 |
| 8,210,808 | B2 * | 7/2012 | Clarence | F04D 29/165 415/168.2 |

(Continued)

FOREIGN PATENT DOCUMENTS

| | | | | |
|---|---|---|---|---|
| CN | 102996520 A | 3/2013 | | |
| EP | 1734231 A1 * | 12/2006 | | F01D 17/165 |

(Continued)

*Primary Examiner* — Sean J Younger

(74) *Attorney, Agent, or Firm* — GE Global Patent Operation; John A. Kramer

(57) ABSTRACT

Various methods and systems are provided for a system for a rotary machine, such as a compressor or turbocharger. In one example, the rotary machine includes a volute assembly and a bearing housing. The volute assembly has a first connector that is configured to interlock with a second connector of the bearing housing. The first and second connectors are configured to engage to a greater extent through relative rotation between the volute assembly and the bearing housing.

14 Claims, 8 Drawing Sheets

(56) References Cited

U.S. PATENT DOCUMENTS

| | | | | |
|---|---|---|---|---|
| 8,215,919 | B2 | 7/2012 | Jewess et al. | |
| 8,376,721 | B2 * | 2/2013 | Thayer | F02B 39/00 417/360 |
| 9,115,599 | B2 * | 8/2015 | Schumnig | |
| 2011/0014032 | A1 * | 1/2011 | Boening | F01D 17/165 415/148 |
| 2012/0151915 | A1 | 6/2012 | Dullack et al. | |
| 2012/0328422 | A1 * | 12/2012 | Lischer | F01D 9/026 415/182.1 |
| 2013/0089418 | A1 | 4/2013 | Boening et al. | |

FOREIGN PATENT DOCUMENTS

| | | | | |
|---|---|---|---|---|
| RU | 2232303 | C1 | 7/2004 | |
| RU | 2368814 | C1 | 9/2009 | |
| WO | 2009101167 | A1 | 8/2009 | |
| WO | WO 2010002717 | A2 * | 1/2010 | F01D 25/162 |
| WO | 2012059481 | A1 | 5/2012 | |

* cited by examiner

ROTARY MACHINE HAVING A VOLUTE ASSEMBLY-BEARING HOUSING JOINT WITH INTERLOCKING TEETH

FIELD

Embodiments of the subject matter disclosed herein relate to turbochargers. Other embodiments relate to reducing damage to turbocharger components due to turbocharger compressor wheel burst.

BACKGROUND

Rotary machines, such as turbochargers and compressors, may be used in an engine system to increase pressure of air supplied to the engine for combustion. A turbocharger generally includes an exhaust-driven turbine disc mechanically coupled to a compressor wheel. Rotating at high speed against a significant head pressure, the compressor wheel is subject to extreme mechanical stress during engine operation. If the compressor wheel is defective, such stress may cause the wheel to fracture. In some scenarios, fracture of the compressor wheel may cause the wheel to burst into fragments, resulting in damage to various parts of the turbocharger and/or the engine. In particular, high-velocity fragments that break through the compressor wheel housing may damage various other engine components, cause injury, etc. The extent of the damage may be limited, however, if the fragments of the burst compressor wheel remain confined within the housing.

In a state-of-the-art diesel locomotive, for example, the turbocharger includes a compressor wheel housing which surrounds a compressor wheel that rotates to increase angular momentum of a gas, and a volute that collects the gas and delivers it to an outlet. The volute is coupled to a bearing housing at a volute assembly-bearing housing joint by a plurality of fasteners. During a compressor wheel burst event, the compressor wheel housing may contain the compressor fragments, however, the high-velocity fragments may impact the volute assembly-bearing housing joint with such a force that volute assembly-bearing housing joint failure occurs.

BRIEF DESCRIPTION

In one embodiment, a system for a rotary machine includes a volute assembly having a first connector configured to interlock with a second connector of a bearing housing. (When assembled, the first connector interlocks with the second connector.) The first and second connectors are configured to engage to a greater extent through relative rotation between the volute assembly and the bearing housing. In one example, the volute assembly includes a first flange which has a first plurality of teeth (e.g., first connectors) extending radially from its perimeter, and the bearing housing includes a second flange which has a second plurality of teeth (e.g., second connectors) extending radially from its perimeter. In such an example, the first plurality of teeth and the second plurality of teeth are configured to interlock for coupling the bearing housing and the volute assembly together.

In this way, a volute assembly-bearing housing joint formed when the volute assembly and bearing housing are coupled together by the first and second connectors may have increased axial tensile load strength, as compared to when the first flange and second flange are only bolted together. As such, during a compressor wheel burst event, degradation of the volute assembly-bearing housing joint may be reduced despite an increased impact energy due to compressor wheel fragments being contained within a compressor housing.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of a system for a rotary machine, comprising a volute assembly and a bearing housing, and a rotary machine comprising the volute assembly and bearing housing coupled together. When coupled, the volute assembly and bearing housing form a volute assembly-bearing housing joint of the rotary machine. In the example embodiments described herein, the volute assembly and bearing housing are coupled together by first connectors and second connectors, as well as by a plurality of fasteners. The first connectors and second connectors may be interlocking teeth or complementary threaded connectors, for example. In one particular example, the volute assembly includes a first flange with a first plurality of teeth and the bearing housing includes a second flange with a second plurality of teeth. Each tooth of the first plurality of teeth extends downward while each tooth of the second plurality of teeth extends outward such that each tooth of the first plurality of teeth may engage a respective tooth of the second plurality of teeth. In this manner, when the volute assembly and bearing housing are connected, the first plurality of teeth and the second plurality of teeth are interlocked such that an axial tensile load strength of the volute assembly-bearing housing joint is increased as compared to when the first flange and second flange are only bolted together. As such, the volute assembly-bearing housing joint may be more likely to withstand a compressor wheel burst event.

In one embodiment, the volute assembly and bearing housing (comprising, when connected, the volute assembly-bearing housing joint) are part of a rotary machine, such as a turbocharger, which may be coupled to an engine in a vehicle. A locomotive system is used to exemplify one of the types of vehicles having engines to which a turbocharger, or multi-turbocharger, may be attached. Other types of vehicles may include other types of rail vehicles, on-highway vehicles, off-highway vehicles other than rail vehicles, mining equipment, and marine vessels. Other embodiments of the invention may be used for turbochargers that are coupled to stationary engines. The engine may be a diesel engine, or may combust another fuel or combination of fuels. Such alternative fuels may include gasoline, kerosene, biodiesel, natural gas, and ethanol. Suitable engines may use compression ignition and/or spark ignition.

Figure 1:
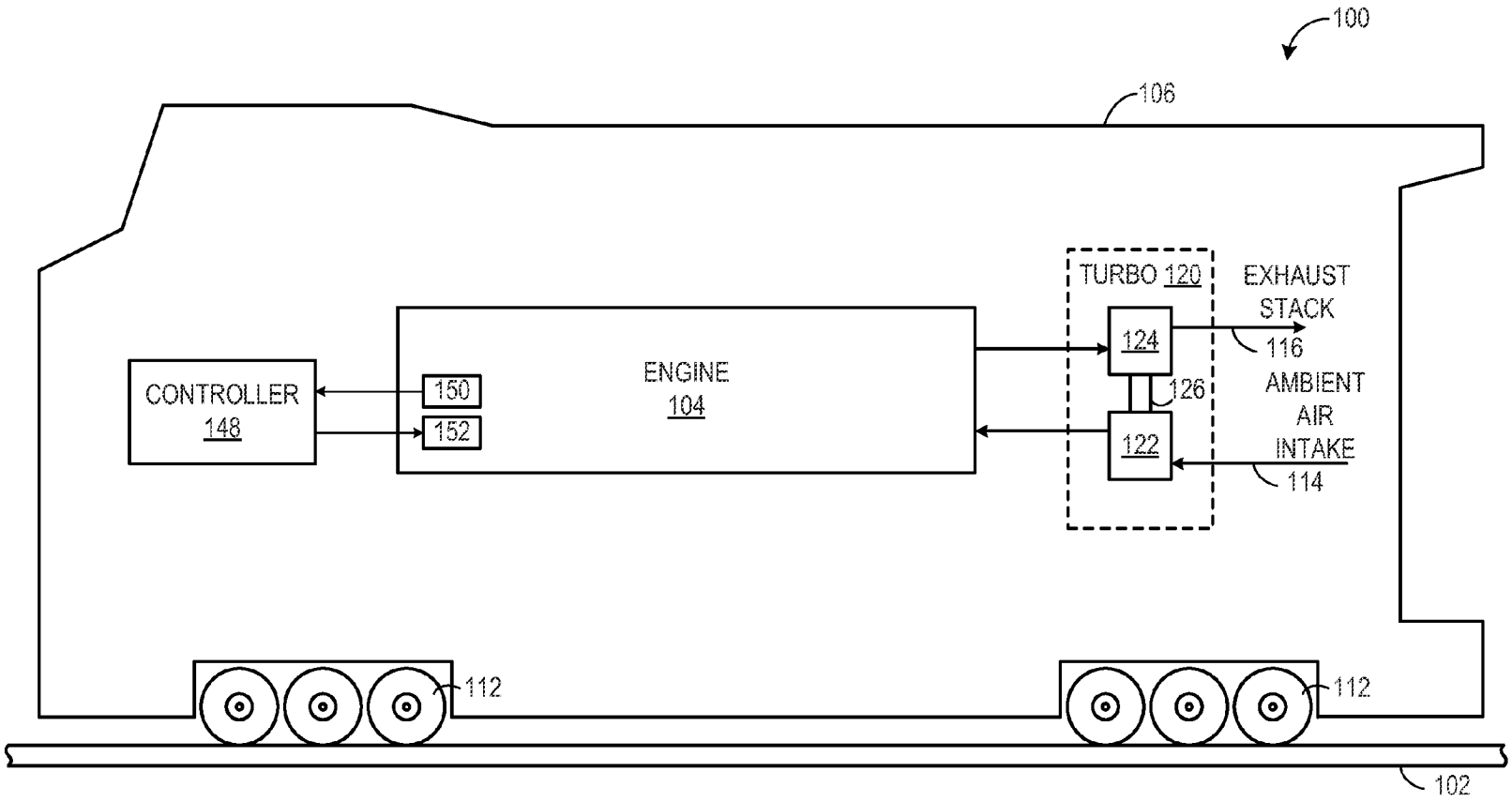
FIG. 1 shows a schematic diagram of an embodiment of a vehicle with a rotary machine.

FIG. 1 shows a block diagram of an exemplary embodiment of a vehicle system 100 (e.g., a locomotive system), herein depicted as a rail vehicle 106, configured to run on a rail 102 via a plurality of wheels 112. As depicted, the rail vehicle 106 includes an engine system with an engine 104.

The engine 104 receives intake air for combustion from an intake passage 114. The intake passage 114 receives ambient air from an air filter (not shown) that filters air from outside of the rail vehicle 106. Exhaust gas resulting from combustion in the engine 104 is supplied to an exhaust passage 116. Exhaust gas flows through the exhaust passage 116, and out of an exhaust stack of the rail vehicle 106.

The engine system includes a turbocharger 120 ("TURBO") that is arranged between the intake passage 114 and the exhaust passage 116. The turbocharger 120 increases air charge of ambient air drawn into the intake passage 114 in order to provide greater charge density during combustion to increase power output and/or engine-operating efficiency. The turbocharger 120 includes a compressor 122 which is at least partially driven by a turbine 124 via a shaft 126. While in this case a single turbocharger is shown, the system may include multiple turbine and/or compressor stages. Further, in some examples, the turbocharger 120 may be bolted to the engine. In other examples, the turbocharger 120 may be coupled between the exhaust passage and the intake passage of the engine. In still other examples, the turbocharger 120 may be coupled to the engine by any other suitable manner. The term "turbocharger" as used herein refers generally to devices for compressing intake air for an engine, and includes true turbochargers, where the air is compressed by action of exhaust on a turbine driving a compressor, and superchargers, where the air is compressed by a compressor being driven by a shaft driven by an engine or motor.

In some embodiments, the vehicle system 100 may further include an exhaust gas treatment system coupled in the exhaust passage upstream or downstream of the turbocharger 120. In one example embodiment, the exhaust gas treatment system may include a diesel oxidation catalyst (DOC) and a diesel particulate filter (DPF). In other embodiments, the exhaust gas treatment system may additionally or alternatively include one or more emission control devices. Such emission control devices may include a selective catalytic reduction (SCR) catalyst, three-way catalyst, $NO_x$ trap, or various other devices or systems.

The rail vehicle 106 further includes a controller 148 to control various components related to the vehicle system 100. In one example, the controller 148 includes a computer control system. The controller 148 further includes computer readable storage media (not shown) including code for enabling on-board monitoring and control of rail vehicle operation. The controller 148, while overseeing control and management of the vehicle system 100, may be configured to receive signals from a variety of engine sensors 150, as further elaborated herein, in order to determine operating parameters and operating conditions, and correspondingly adjust various engine actuators 152 to control operation of the rail vehicle 106. For example, the controller 148 may receive signals from various engine sensors 150 including, but not limited to, engine speed, engine load, boost pressure, exhaust pressure, ambient pressure, exhaust temperature, etc. Correspondingly, the controller 148 may control the vehicle system 100 by sending commands to various components such as fraction motors, alternator, cylinder valves, throttle, etc.

FIGS. 2-12 show various views of a volute assembly 200 and/or a bearing housing 300 of a rotary machine, such as a turbocharger. (As noted above, embodiments of the invention relate to a system for a rotary machine comprising the volute assembly 200 and bearing housing 300, which are configured to be coupled together for forming part of the rotary machine.) The volute assembly 200 and bearing housing 300 may be part of the turbocharger 120 described above with reference to FIG. 1, for example, which is installed in an engine system of a vehicle. In other examples, the volute assembly 200 and bearing housing 300 may be part of a compressor. As described above, the volute assembly 200 may include a first connector (e.g., a first plurality of teeth) and the bearing housing 300 may include a second connector (e.g., a second plurality of teeth) which are configured to interlock such that the volute assembly 200 and the bearing housing 300 may be coupled together. The first and second connectors may become engaged with each other to a greater extent through relative rotation between the volute assembly and the bearing housing, such relative rotation about the same rotational axis about which the compressor and turbine rotate through shaft 126. For example, the first and second connectors can form a screw-type coupling via threads on each of the volute assembly and bearing housing such that relative rotation, along with translation due to the threads, further engages them to one another. In another example, the connectors may include teeth that become more interlocked with one another through relative rotation of the volute assembly and the bearing housing.

In one embodiment, a rotary machine comprises a volute assembly having a first flange which has a first plurality of teeth extending radially downward from a perimeter of the first flange, each tooth of the first plurality of teeth spaced from the first flange by a respective connector which extends perpendicular to the first flange. The rotary machine further comprises a bearing housing having a second flange, the second flange having a second plurality of teeth extending radially outward from a perimeter of the second flange. An outer portion of each of the second plurality of teeth is overlapped by a respective tooth of the first plurality of teeth.

In another embodiment, a rotary machine comprises a volute assembly having a first flange with a first plurality of teeth extending radially downward from a perimeter of the first flange. The rotary machine further comprises a bearing housing having a second flange with a second plurality of teeth extending radially outward from a perimeter of the second flange. The first plurality of teeth overlap the second plurality of teeth to couple the volute assembly to the bearing housing at a volute assembly-bearing housing joint. The rotary machine further comprises a plurality of fasteners configured to further couple the first flange to the second flange at the volute assembly-bearing housing joint.

Figure 2:
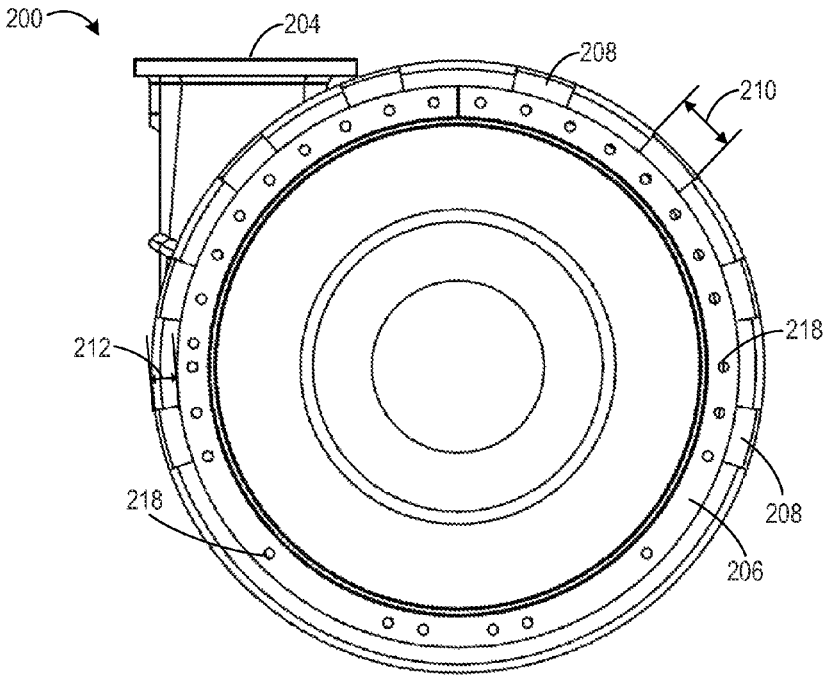
FIG. 2 shows a view of a volute assembly of a rotary machine which includes a first flange.
Figure 3:
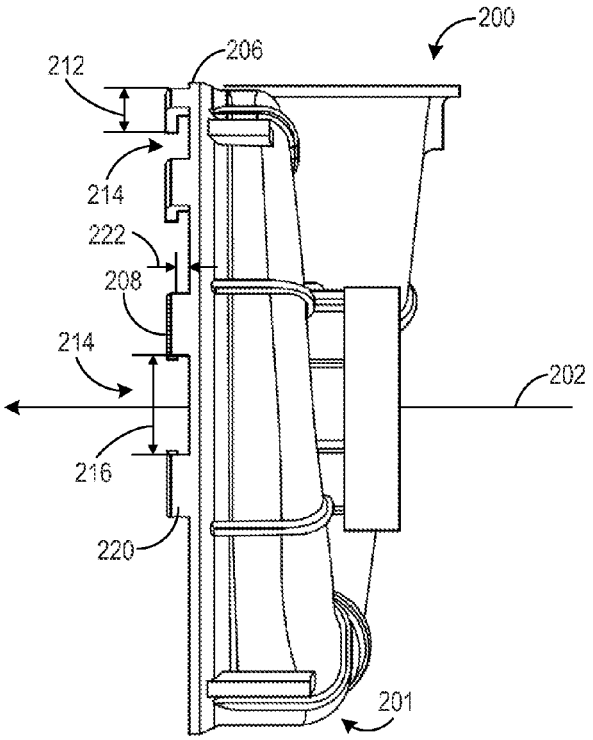
FIG. 3 shows a side view of a volute assembly of a rotary machine.
Figure 4:
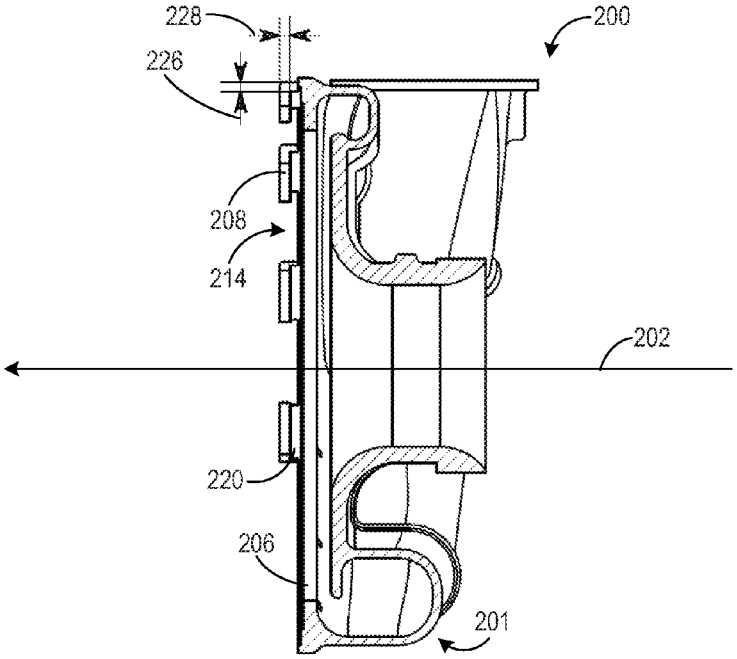
FIG. 4 shows a cross-sectional view of a volute assembly of a rotary machine.
Figure 5:
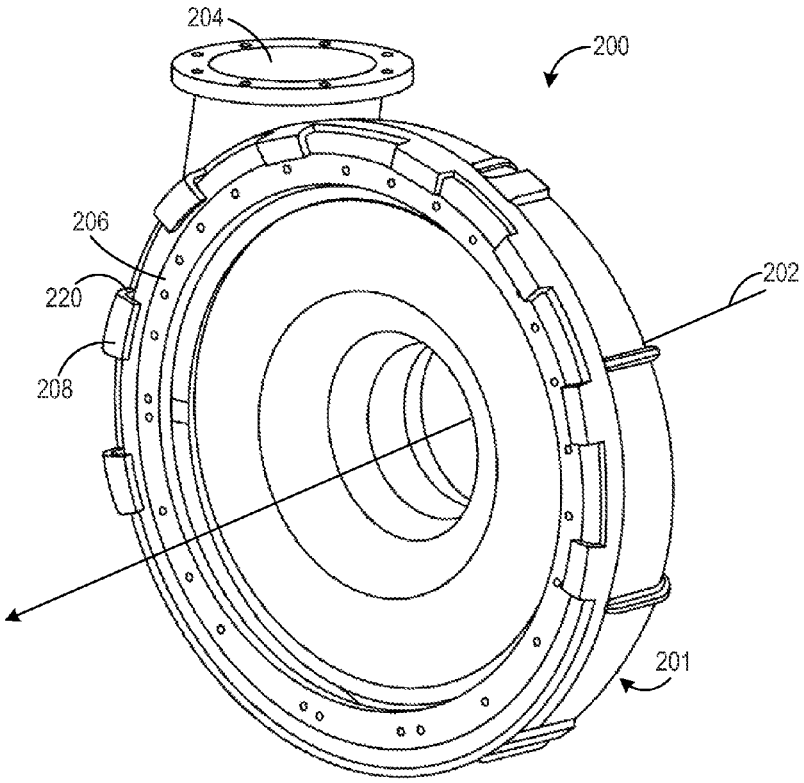
FIG. 5 shows a perspective view of a volute assembly of a rotary machine.

Continuing to FIGS. 2-5, various views of a volute assembly 200 of a rotary machine, such as the turbocharger 120 described above with reference to FIG. 1, are shown. For example, FIG. 2 shows a view of a flange-side of the volute assembly 200; FIG. 3 shows a right side of the volute assembly 200 (e.g., the right side of volute assembly 200 based on the view depicted in FIG. 2); FIG. 4 shows a cross-sectional view of the volute assembly 200 taken perpendicular to a turbocharger rotational axis 202 defined by the volute assembly 200 and a bearing housing 300 when connected; and FIG. 5 shows a perspective view of the right side of the volute assembly 200.

The volute assembly 200 comprises a volute portion 201 and a first flange 206 connected to the volute portion 201. The first flange and the volute portion may be an integral component (formed of/from the same piece of material), or they may be separate components connected together, via fasteners, welding, or the like. The volute portion 201 is configured to channel intake air compressed by a compressor. For example, the volute portion 201 collects gas (e.g., engine intake air) from a rotating impeller of the compressor of the turbocharger, and delivers the gas to an outlet 204. The volute portion 201 is curved such that a rate of flow of the gas is reduced, and kinetic energy is converted to potential energy, thereby increasing a pressure of the gas.

As depicted in FIGS. 2-5, the volute assembly 200 includes the first flange 206 which includes a first plurality of teeth 208 (e.g., a first connector). The first flange 206 is annular and coaxial with the turbocharger rotational axis 202 defined by the volute assembly 200 and the bearing housing 300 when connected. The first plurality of teeth 208 extend radially downward from a perimeter of the first flange 206, and parallel to the first flange 206. In the example depicted in FIGS. 2-5, the first plurality of teeth 208 includes eight teeth which are evenly spaced around a portion of the circumference of the first flange 206 (e.g., within a 270 degrees range of the perimeter). In other examples, the first plurality of teeth 208 may be spaced evenly about the entire 360 range of the perimeter of the first flange 206). In still other examples, the first plurality of teeth 208 may be spaced in another suitable manner in a desired range of the perimeter of the first flange 206. Further, the first plurality of teeth 208 may include more than or less than eight teeth.

In some examples, the first flange 206 and the first plurality of teeth 208 may be integral with the volute portion 201. In other examples, the first flange 206 and the first plurality of teeth 208 may be attached to the volute portion (either directly or by way of an intermediate member(s) that is in turn attached to the volute portion 201) with an attachment means that is at least as strong as the interlocking teeth and fastener connection describe herein.

In the example shown in FIGS. 2-5, each tooth of the first plurality of teeth 208 has a same width 210. In other examples, some or all of the first plurality of teeth 208 may have different widths. Further, the width 210 of each tooth of the first plurality of teeth 208 may be the same along a length 212 of each tooth, as depicted. In other examples, the width of each tooth of the first plurality of teeth 208 may increase or decrease with distance from a center of the first flange 206. As shown, the length 212 (e.g., a distance from the perimeter of the first flange 206 to a closest distance of the tooth to the turbocharger rotational axis 202) of each tooth of the first plurality of teeth 208 is the same. In other examples, some or all of the first plurality of teeth 208 may have different lengths. Further, the length 212 of each tooth of the first plurality of teeth 208 is limited by a position of a first plurality of fastener apertures 218. For example, the length 212 may only extend so far, as clearance is needed for a bolt head and a socket required to fasten/unfasten the fasteners from the first flange 206.

Further, in the examples of FIGS. 2-5, a thickness 228 of each tooth of the first plurality of teeth 208 is less than a thickness of the first flange 206. In other examples, the thickness 228 of each tooth of the first plurality of teeth 208 may be greater than or equal to the thickness of the first flange 206.

Each tooth of the first plurality of teeth 208 is spaced from the first flange 206 by a respective connector 220. Each connector 220 extends away from and perpendicular to the first flange 206 (e.g., parallel to the turbocharger rotational axis 202), and couples each tooth of the first plurality of teeth 208 to the perimeter of first flange 206. The connector 220 has a length 222 which may correspond to a thickness of a tooth of the second plurality of teeth 308. For example, the length 222 may be such that a tooth of the second plurality of teeth 308 fits snugly inside a space between a respective tooth of the first plurality of teeth 208 and the first flange 206. Further, the connector 220 has a thickness 226 which may be substantially the same as the thickness 228 of each tooth of the first plurality of teeth 228. In other examples, the connector 220 may have a thickness 226 which is less than or greater than the thickness 228 of each tooth of the first plurality of teeth 228.

The first flange 206 may be machined or casted such that the first plurality of teeth 208 and the connector 220 are part of the first flange 206. As such, each tooth of the first plurality of teeth 208 and the connector 220 may be made of the same material as the first flange 206. For example, the first flange 206, the first plurality of teeth 208, and the connector 220 may be made of cast iron, steel, or another suitable material.

As shown in FIGS. 2-5, the first flange 206 further includes a first set of slots 214. Each tooth of the first plurality of teeth 208 is separated from an adjacent tooth of the first plurality of teeth 208 by a respective slot of the first set of slots 214, for example. As such, the number of slots in the first set of slots 214 corresponds to the number of teeth in the first plurality of teeth 208. For example, in the example depicted in FIGS. 2-5, the first flange 206 includes seven slots 214 separating the eight teeth 208. In other examples in which the first plurality of teeth 208 are spaced around the entire perimeter of the first flange 206, the first set of slots 214 may include a number of slots equal to the number of teeth of the first plurality of teeth 208. Further, as depicted in FIGS. 2-5, each slot of the first set of slots 214 has a same width 216, and the width 216 of each slot of the first set of slots 214 is greater than the width 210 of each tooth of the first plurality of teeth 208. In other examples, some or all of the slots of the first set of slots 214 may have a different width. In still other examples, each slot of the first set of slots 214 may have a same width 216 as each tooth of the first plurality of teeth 208, or a smaller width than each tooth of the first plurality of teeth 208. As shown, each slot of the first set of slots 214 is an empty space (e.g., filled with air) between two teeth.

The first flange 206 further includes a first plurality of fastener apertures 218. Each fastener aperture of the first plurality of fastener apertures 218 is configured to receive a respective fastener such that the first flange 206 may be coupled to another object, such as a second flange 306 which is described in greater detail below, via a plurality of fasteners, such as bolts. In the example shown in FIGS. 2-5, the first plurality of fastener apertures 218 is spaced all the way around the first flange 206 at a particular radius (e.g., each fastener aperture of the first plurality of fastener apertures 218 is at the particular radius from the center of the first flange 206). Although the first plurality of fastener apertures 218 is depicted in a somewhat random array around the first flange 206 in FIGS. 2-5, in other examples, the first plurality of fastener apertures 218 may be positioned in a radially symmetric arrangement around a circumference of the first flange 206, or arranged in another pattern.

Thus, the volute assembly 200 includes a first flange 206 with a first plurality of teeth 208. Each tooth of the first plurality of teeth 208 is spaced from the first flange 206, extends downward, and is configured to engage a respective tooth of another flange (such as a respective tooth of the second plurality of teeth 308 of the second flange 306 described below). Further, the first flange 206 includes a plurality of fastener apertures 218 such that the first flange 206 may be fastened to another object, such as the second flange 306, via a plurality of fasteners. In this way, the volute assembly 200 may be coupled to a bearing housing 300 not only by the plurality of fasteners, but also by the first plurality of teeth 208 which engage a respective tooth of the second plurality of teeth 308 and assist in holding the second flange 306 against the first flange 206.

Figure 6:
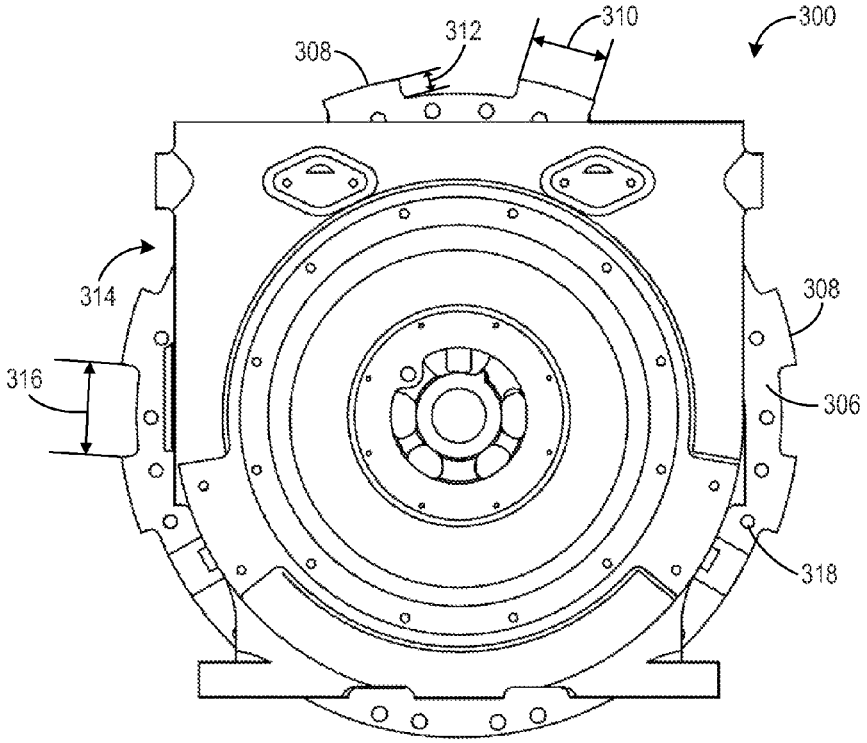
FIG. 6 shows a view of a bearing housing of a rotary machine.
Figure 7:
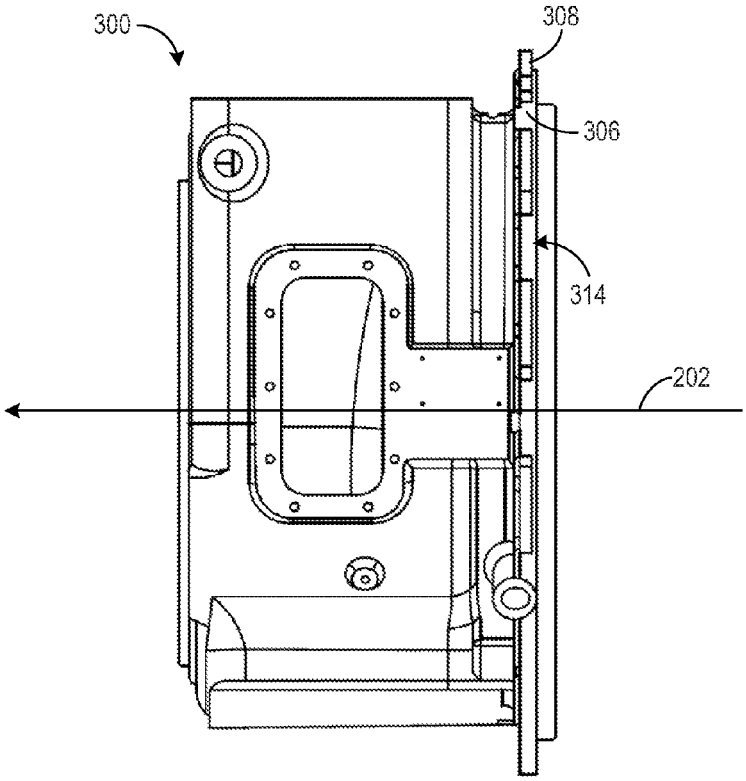
FIG. 7 shows a side view of a bearing housing of a rotary machine.
Figure 8:
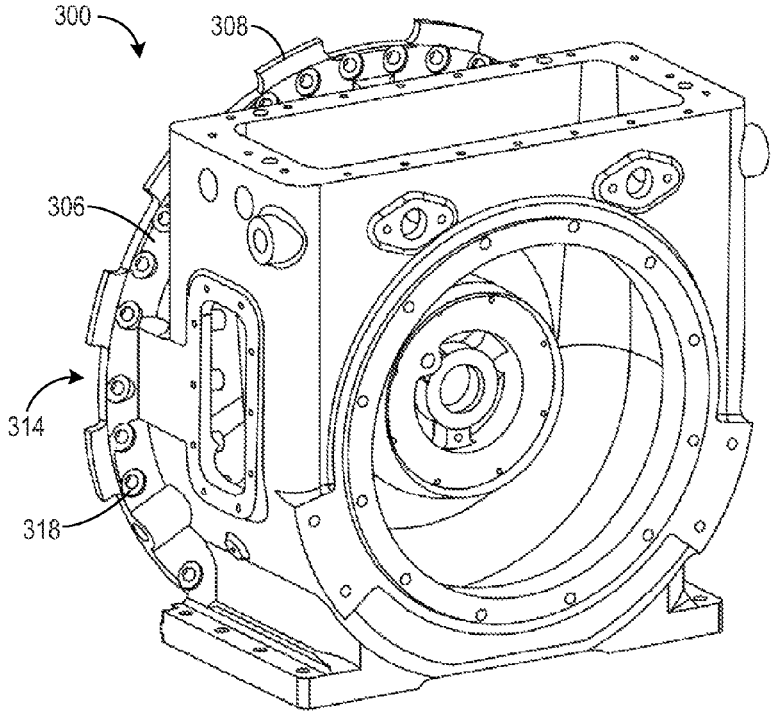
FIG. 8 shows a perspective view of a bearing housing of a rotary machine.

FIGS. 6-8 show various views of a bearing housing 300 of a rotary machine, such as the turbocharger 120 described above with reference to FIG. 1. For example, FIG. 6 shows a view of a non-flange side of the bearing housing 300; FIG. 7 shows a right side view of the bearing housing 300 (e.g., the right side of the bearing housing 300 based on the view depicted in FIG. 6); and FIG. 8 shows a perspective view of a left side of the bearing housing 300.

The bearing housing 300 is configured to support rotor components of the turbocharger and bear the mechanical load of the rotor components. For example, the bearing housing is configured to house and support a turbocharger shaft to be coupled to the compressor and a turbine. The turbine is connected to a first end of the shaft, and the compressor is connected to a distal, second end of the shaft and in fluid communication with a volute portion of the volute assembly for compressing intake air for routing through the volute portion.

As depicted in FIGS. 6-8, the bearing housing 300 includes a second flange 306 which includes a second plurality of teeth 308 (e.g., a second connector). The second flange 306 is annular and coaxial with the turbocharger rotational axis 202. The second plurality of teeth 308 extend radially from a perimeter of the second flange 306. In the example depicted in FIGS. 6-8, the second plurality of teeth 308 includes eight teeth which are evenly spaced around a portion of the circumference of the second flange 306 (e.g., within a 270 degrees range of the perimeter). In other examples, the second plurality of teeth 308 may be spaced evenly about the entire 360 degree range of the perimeter of the second flange 306). In still other examples, the second plurality of teeth 308 may be spaced in another suitable manner in a desired range of the perimeter of the second flange 306. Further, the second plurality of teeth 308 may include more than or less than eight teeth.

It should be noted that the second flange 306 of the bearing housing 300 includes a same number of teeth as the first flange 206 of the volute 200 (described above with reference to FIGS. 2-5). In this way, each tooth of the first plurality of teeth 208 may engage a respective tooth of the second plurality of teeth 308 upon rotation of the volute assembly 200 with respect to the bearing housing 300 such that the volute assembly 200 and the bearing housing 300 may be coupled together via interlocking teeth (e.g., the first plurality of teeth 208 and the second plurality of teeth 308), and a volute assembly-bearing housing joint 400 is formed, as will be described in greater detail below.

Continuing with the example shown in FIGS. 6-8, each tooth of the second plurality of teeth 308 has a same width 310. In other examples, some or all of the second plurality of teeth 308 may have different widths. Further, the width 310 of each tooth of the second plurality of teeth 308 may increase or decrease with distance from a center of the second flange 306. For example, as depicted sides of each tooth of the second plurality of teeth 308 are curved such that a bottom portion of the each tooth is wider than a top portion of each tooth of the second plurality of teeth 308. As shown, the length 312 (e.g., a distance from the perimeter of the second flange 306 to a furthest distance of the tooth from a center of the second flange 306) of each tooth of the second plurality of teeth 308 is the same. In other examples, some or all of the second plurality of teeth 308 may have different lengths. The length 312 of each tooth of the second plurality of teeth 308 may be shorter than the length of each tooth of the first plurality of teeth 208, described above, for example. In this way, when the first flange 206 and the second flange 306 are aligned, each tooth of the first plurality of teeth 208 may engage a respective tooth of the second plurality of teeth 308, as described in greater detail below.

Further, in the examples of FIGS. 6-8, a thickness of each tooth of the second plurality of teeth 308 is substantially equal to a thickness of the second flange 306. In other examples, the thickness of each tooth of the second plurality of teeth 308 may be greater than or less than the thickness of the second flange 306. In other examples, such as shown in FIGS. 9-12, the thickness of each tooth of the second plurality of teeth 308 is slightly less than a thickness of the second flange 306.

The second flange 306 may be machined or casted such that the second plurality of teeth 308 are part of the second flange 306. As such, each tooth of the second plurality of teeth 308 may be made of the same material as the second flange 306. For example, the second flange 306 and the second plurality of teeth 308 may be made of cast iron, steel, or another suitable material.

The second flange 306 further includes a second set of slots 314. Each tooth of the second plurality of teeth 308 is separated from an adjacent tooth of the second plurality of teeth 308 by a respective slot of the second set of slots 314, for example. As such, the number of slots in the second set of slots 314 corresponds to the number of teeth in the second plurality of teeth 308. For example, in the example depicted in FIGS. 6-8, the second flange 306 includes seven slots 314 separating the eight teeth 308. In other examples in which the second plurality of teeth 308 are spaced around the entire perimeter of the second flange 306, the second set of slots 314 may include a number of slots equal to the number of teeth of the second plurality of teeth 308. Further, as depicted in FIGS. 6-8, each slot of the second set of slots 314 has a same width 316, and the width 316 of each slot of the second set of slots 314 is greater than the width 310 of each tooth of the second plurality of teeth 308. In other examples, some or all of the slots of the second set of slots 314 may have a different width. In still other examples, each slot of the second set of slots 314 may have a same width 316 as each tooth of the second plurality of teeth 308, or a smaller width than each tooth of the second plurality of teeth 308. As shown, each slot of the second set of slots 314 is an empty space (e.g., filled with air) between two teeth.

The second flange 306 further includes a second plurality of fastener apertures 318. Each fastener aperture of the second plurality of fastener apertures 318 is configured to receive a respective fastener such that the second flange 306 may be coupled to another object, such as the first flange 206 which is described in greater detail above, via a plurality of fasteners, such as bolts. In the example shown in FIGS. 6-8, the second plurality of fastener apertures 318 is spaced all the way around the second flange 306 at a particular radius (e.g., each fastener aperture of the second plurality of fastener apertures 318 is at the particular radius from the center of the second flange 306). Although the second plurality of fastener apertures 318 is depicted in a somewhat random array around the second flange 306 in FIGS. 6-8, in other examples, the second plurality of fastener apertures 318 may be positioned in a radially symmetric arrangement around a circumference of the second flange 306, or arranged in another pattern.

Thus, the bearing housing 300 includes a second flange 306 which includes a second plurality of teeth 308. As described above, the second plurality of teeth 308 are configured such that they may fit within a space between a respective tooth of the first plurality of teeth 208 and the first flange 206. In this way, the second plurality of teeth 308 are configured to interlock with the first plurality of teeth 208. Further, the second flange 306 includes a plurality of fastener apertures 318 such that the second flange 306 may be fastened to another object, such as the first flange 206, via a plurality of fasteners.

Figure 9:
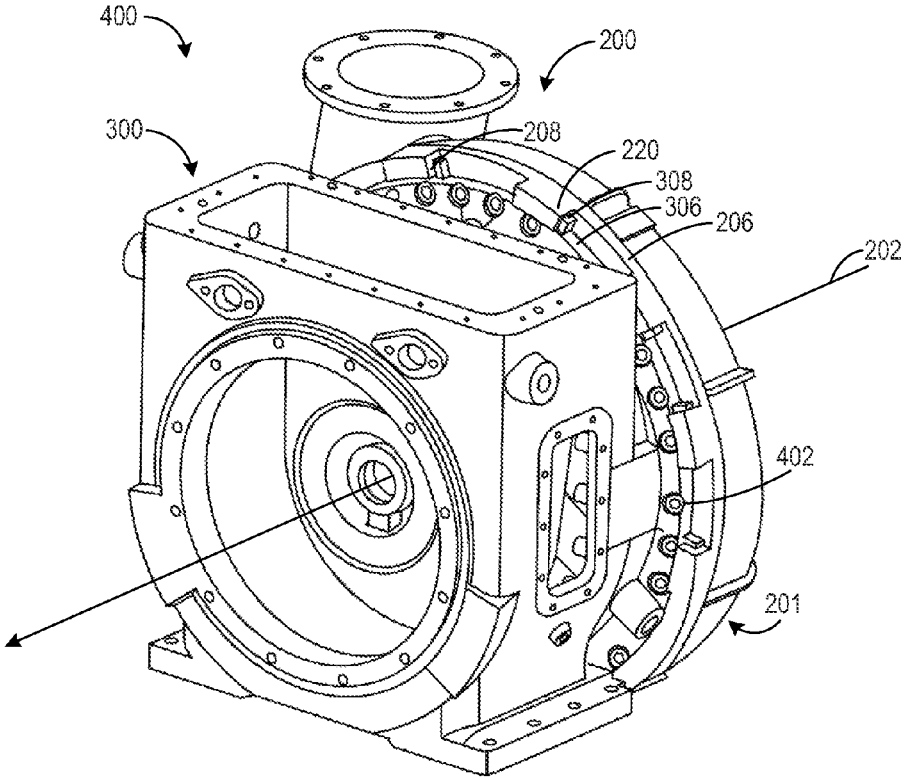
FIG. 9 shows a perspective view of a volute and bearing housing of a rotary machine coupled together.
Figure 10:
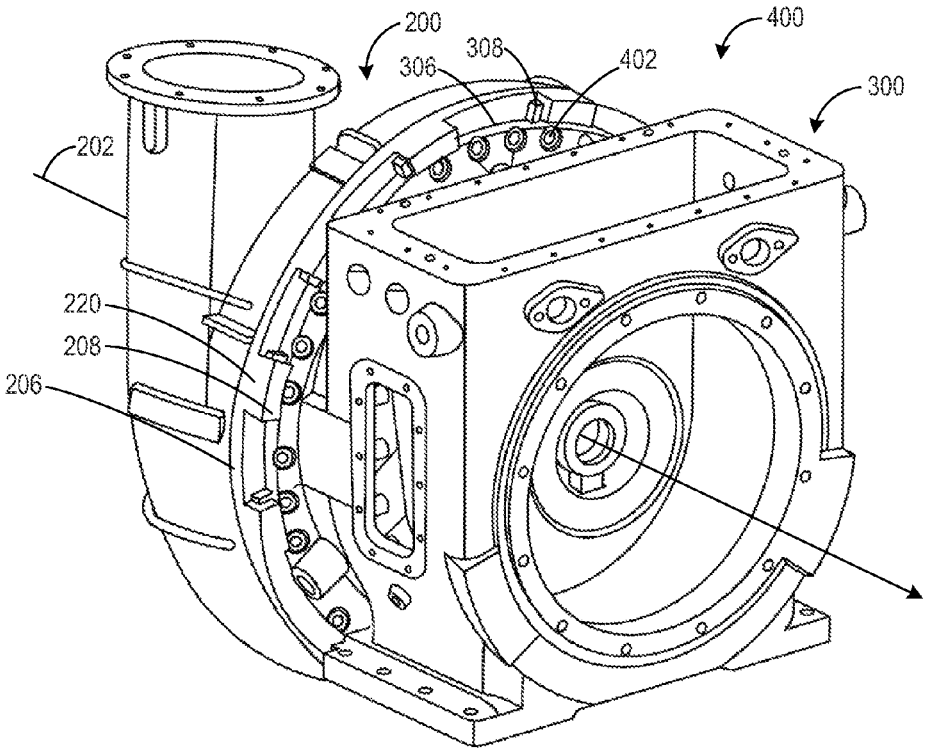
FIG. 10 shows a perspective view of a volute and bearing housing of a rotary machine coupled together.
Figure 11:
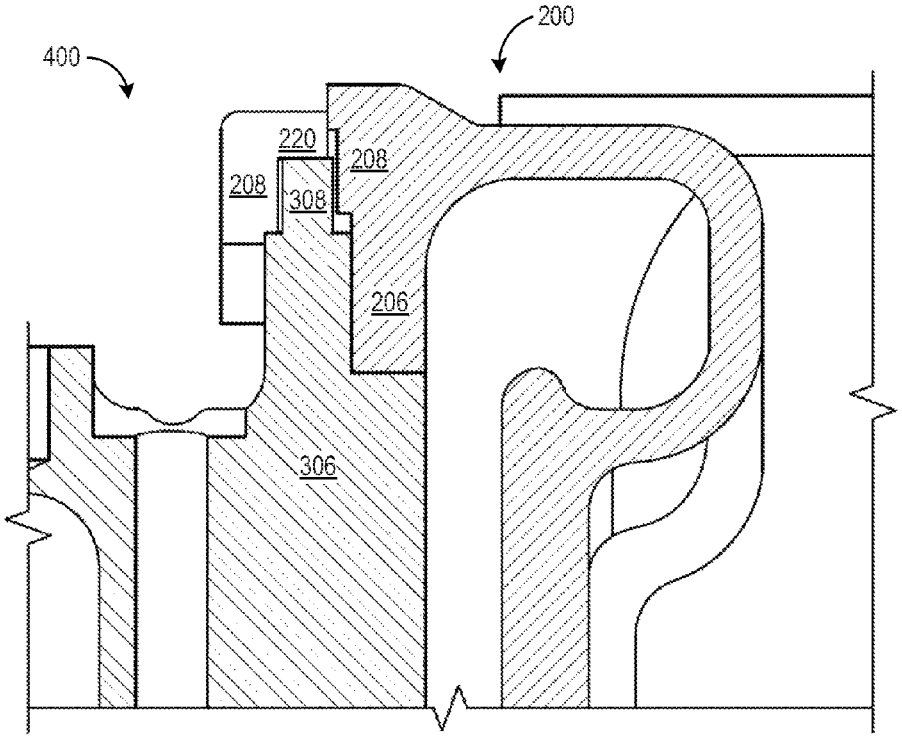
FIG. 11 shows a cross-sectional view of a volute assembly-bearing housing joint.
Figure 12:
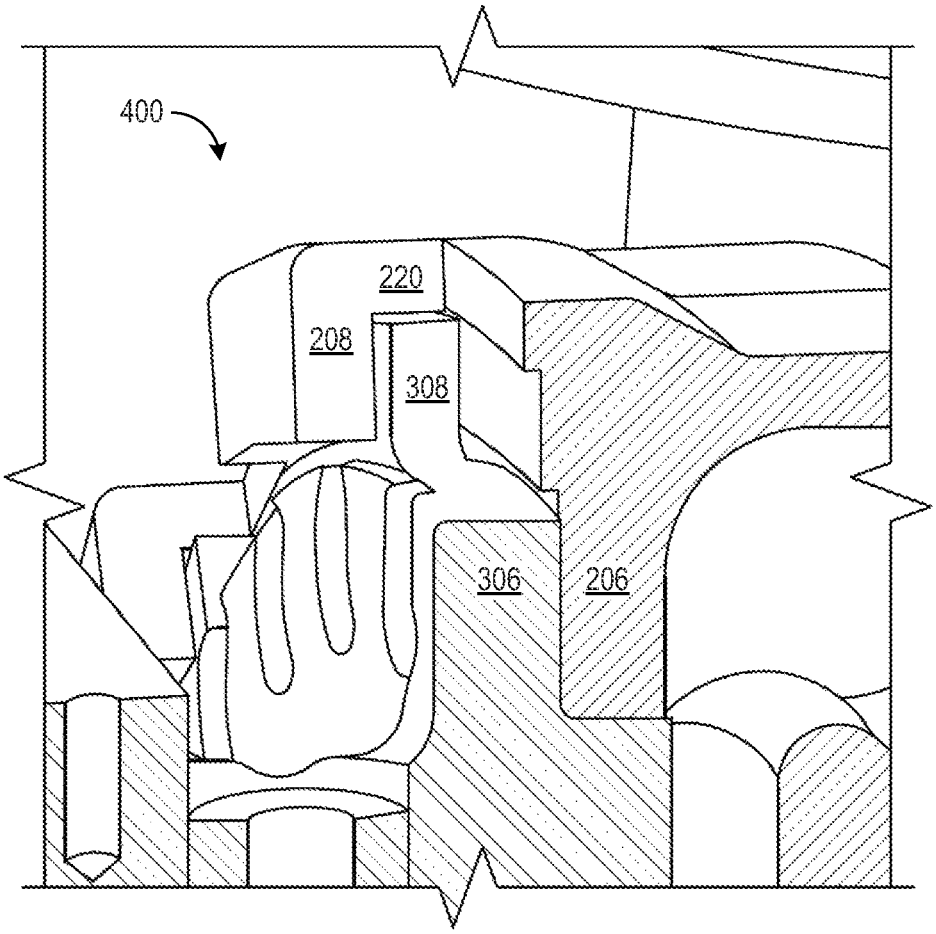
FIG. 12 shows a cross-sectional view of a volute assembly-bearing housing joint.

FIGS. 9-12 show various views of a volute assembly, such as the volute assembly 200 described above with reference to FIGS. 2-5, and a bearing housing, such as the bearing housing 300 described above with reference to FIGS. 6-8, in a state in which they are coupled together via interlocking teeth and a plurality of fasteners to form a volute assembly-bearing housing joint 400. For example, FIGS. 9 and 10 show perspective views of the volute assembly-bearing housing joint 400; FIG. 11 shows a cross-sectional view of the volute assembly-bearing housing joint 400 taken perpendicular to the turbocharger rotational axis 202 defined by the volute assembly 200 and the bearing housing 300 when connected; and FIG. 12 shows another cross-sectional view of the volute assembly-bearing housing joint.

The interlocking connectors (e.g., the first plurality of teeth 208 and the second plurality of teeth 308) may be configured such that the volute assembly-bearing housing joint 400 may withstand an impact of a high-energy fragment, such as fragments of a compressor wheel that may be released during a compressor wheel burst event. For example, the volute assembly-bearing housing joint 400 is configured to prevent detachment of the bearing housing 300 from the volute assembly 200 when energy is applied internally to at least one of the volute assembly or the bearing housing by components of the compressor during a failure condition. The joint 400 may be configured to prevent detachment at a maximum possible energy level released by the compressor (e.g., the compressor wheel) during a failure condition when the engine is operating in its rated range. Burst conditions may occur if there is a malfunction of the compressor structure, or due to the introduction of a foreign object into the compressor. In some burst conditions, one fragment of the compressor wheel may originally be released, and the release of the first fragment may cause additional fragments of the compressor wheel to be released. In some embodiments, the entire compressor wheel may be released during a burst condition. (Thus, "burst condition," "burst event," and "failure condition," which are used synonymously, all refer to a state where a compressor is operating, e.g., at maximum RPM or otherwise, and all or part of the compressor wheel is subject to an unintended release so as to come into contact with the volute assembly, bearing housing, and/or volute assembly-bearing housing joint.)

As depicted in FIGS. 9-12, the first plurality of teeth 208 and the second plurality of teeth 308 are positioned such that they are interlocking. For example, after relative rotation of the volute assembly 200 with respect to the bearing housing 200, each tooth of the first plurality of teeth 208 engages a respective tooth of the second plurality of teeth 308 such that each tooth of the first plurality of teeth 208 is overlapping an outer portion of a respective tooth of the second plurality of teeth 308. In the depicted example, each tooth of the first plurality of teeth 208 overlaps the entire length of the respective tooth of the second plurality of teeth 308. In other examples, each tooth of the first plurality of teeth 208 may overlap only a portion of the respective tooth of the second plurality of teeth 308. Further, as shown, the length 212 of each tooth of the first plurality of teeth 208 is greater than the length 312 of each tooth of the second plurality of teeth 308. For example, the length 212 of each tooth of the first plurality of teeth and the length 312 of each tooth of the second plurality of teeth 308 differ by the thickness 226 of the connector 220.

By forming the volute assembly-bearing housing joint 400 with the interlocking teeth in addition to a plurality of fasteners 402, an axial tensile load strength of the volute assembly-bearing housing joint 400 is increased. As such, the volute assembly-bearing housing joint 400 may withstand a greater force, and thereby contain a greater kinetic energy, during a compressor wheel burst event/burst condition, and less turbocharger degradation (e.g., volute assembly-bearing housing joint failure) may occur.

Figure 13:
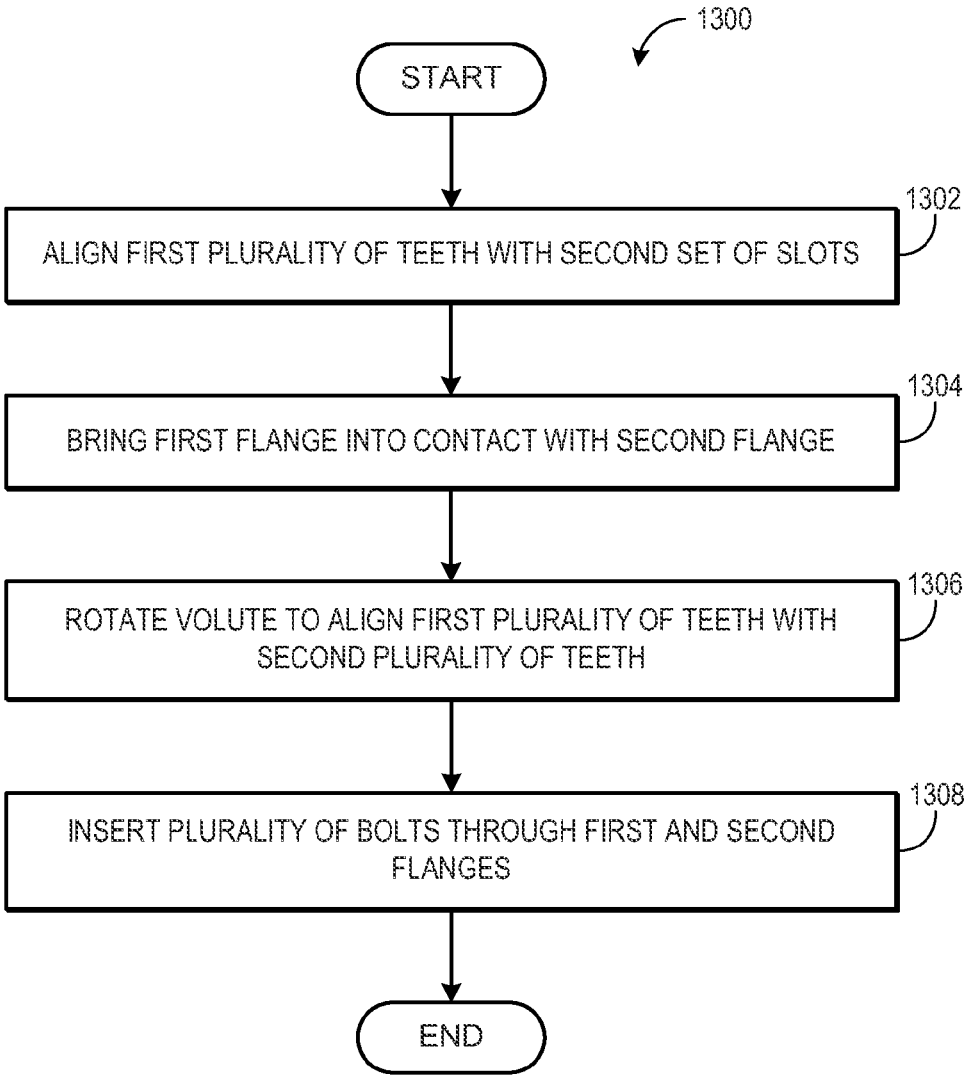
FIG. 13 shows a flow chart illustrating a method for assembling a volute and bearing housing to form a volute assembly-bearing housing joint.

FIG. 13 shows a flow chart illustrating a method 1300 for assembling a volute assembly, such as the volute assembly 200 described above with reference to FIGS. 2-5, and a bearing housing, such as the bearing housing 300 described above with reference to FIGS. 6-8, to form a volute assembly-bearing housing joint, such as the volute assembly-bearing housing joint 400 described above with reference to FIGS. 9-12. Specifically, the method 1300 aligns the volute assembly and bearing housing such that a first connector (e.g., a first plurality of teeth) of the volute and a second connector (e.g., a second plurality of teeth) of the bearing housing may be engaged. Initially, the connectors are offset rotationally from one another fully so that the volute assembly and bearing housing can be positioned adjacent to one another to form a combined housing via face-sharing contact. Then, the volute assembly and bearing housing may be rotated relative to each other about the central axis of the combined housing to engage, for example to interlock, the first and second connectors together. For example, when using teeth, initially offset teeth can become more aligned through the rotation, thus increasing the extent to which the housings are engaged with one another. The engagement may proceed up to full engagement when the teeth are fully positioned flush with each other, such that a set of teeth on the volute assembly are aligned with and trapped by teeth of the bearing housing. In this way, the housing can be engaged to a greater extent upon rotation of the volute assembly relative to the bearing housing. Once the teeth are engaged, a plurality of fasteners are inserted to further couple the volute assembly to the bearing housing.

At step 1302, the first plurality of teeth on the first flange of the volute assembly are aligned with the second set of slots on the second flange of the bearing housing, such that the first flange and second flange share a rotational axis (e.g., centers of the first flange and the second flange are aligned).

At step 1304, the first flange is brought into contact with the second flange. For example, the first flange is moved along the turbocharger rotational axis, without rotating, until the first flange contacts the second flange.

At step 1306, the volute assembly is rotated about the turbocharger rotational axis, such that the first flange is rotated until each tooth of the first plurality of teeth engages a respective tooth of the second plurality of teeth. For example, the volute assembly is rotated by a number of degrees corresponding to a width of a tooth of the second plurality of teeth. In this manner, the first plurality of teeth and the second plurality of teeth become interlocked, as each tooth of the first plurality of teeth overlaps a portion of a respective tooth of the second plurality teeth. In one example, each tooth of the first plurality of teeth may completely overlap a respective tooth of the second plurality of teeth.

At 1308, a plurality of fasteners are inserted through the first and second flanges and tightened such that the volute assembly and bearing house are further coupled together by the plurality of fasteners. For example, each fastener of the plurality of fasteners is inserted through the second flange first, and then through the first flange, or vice versa.

In this way, a volute assembly-bearing housing joint is formed when the volute assembly and bearing housing are coupled together by the interlocking teeth and/or the plurality of fasteners. It should be noted, the fasteners may not be inserted until the first plurality of teeth and the second plurality of teeth are engaged. For example, if the fasteners are inserted before the first flange is rotated, the teeth would not be interlocking, and the functionality of the interlocking teeth would be lost (e.g., the volute assembly-bearing housing joint would not have increased axial tensile load strength from the interlocking teeth during a burst condition).

In an embodiment, a system for a rotary machine comprises a volute assembly and a bearing housing. The volute assembly has a first connector configured to interlock with a second connector of the bearing housing. The first and second connectors are configured to engage to a greater extent through relative rotation between the volute assembly and the bearing housing, e.g., when the volute assembly is rotated relative to the bearing housing (in the direction of movement of engagement of the connectors, such as the direction of rotational movement of the rotary machine), the connectors tend to further engage with one another (that is, are further forced together).

In an embodiment, a system for a rotary machine comprises a volute assembly and a bearing housing. The volute assembly has a first flange, which comprises a first plurality of teeth extending radially from a perimeter of the first flange. The bearing housing has a second flange, which comprises a second plurality of teeth extending radially from a perimeter of the second flange. The first plurality of teeth and the second plurality of teeth are configured to interlock at a volute assembly-bearing housing joint, for coupling the bearing housing and the volute assembly together. Another embodiment relates to a rotary machine comprising a volute assembly and a bearing housing. The volute assembly comprises a volute portion and a first flange connected to the volute portion. The first flange comprises a first plurality of teeth extending radially from a perimeter of the first flange. The bearing housing has a second flange, which comprises a second plurality of teeth extending radially from a perimeter of the second flange. The first plurality of teeth and the second plurality of teeth are interlocked at a volute assembly-bearing housing joint, such that the bearing housing and the volute assembly are coupled together. The bearing housing is further coupled to the volute assembly by a plurality of fasteners extending through the first flange and the second flange. The rotary machine further comprises a shaft housed in and supported by the bearing housing, a turbine connected to a first end of the shaft, and a compressor connected to a distal, second end of the shaft and in fluid communication with the volute portion of the volute assembly for compressing intake air for routing through the volute portion.

In another embodiment of the rotary machine, the volute assembly-bearing housing joint is configured (e.g., the interlocking teeth and fasteners in combination) to prevent detachment of the bearing housing from the volute assembly when energy is applied internally to at least one of the volute assembly or the bearing housing by components of the compressor during a failure condition. For example, the volute assembly-bearing housing joint may be configured to prevent detachment at a maximum possible energy level released by the compressor (e.g., the compressor wheel) during a failure condition when the engine is operating in its rated range.

It should be understood, the interlocking teeth described herein are one example of interlocking connectors. In other embodiments, the volute assembly and bearing housing may be configured to be connected to one another with complementary interlocking connectors (which may be integral with the volute assembly and bearing housing) that are different than the complementary teeth and slots as described herein. For example, in one embodiment, a first one of the volute assembly or the bearing housing comprises an annular threaded stanchion (with contiguous threads or interrupted threads), and the other of the volute assembly or the bearing housing comprises an annular threaded receptacle, which are configured complementary to one another such that the volute assembly and bearing housing may be screwed together by way of the stanchion into the receptacle.

In another embodiment, a system for a rotary machine comprises a volute assembly and a bearing housing. The volute assembly comprises a volute portion and first complementary interlocking connection means attached to the volute portion, for releasable connection of the volute assembly to the bearing housing. The volute portion is configured to route compressed intake air from a compressor to an outlet (e.g., for eventual routing to an engine cylinder bank air intake). The bearing housing comprises a bearing housing body (a structure in which a turbocharger bearing can be housed) and second complementary interlocking connection means attached to the bearing housing body, for releasable connection of the bearing housing to the volute assembly, complementary to the first connection means. That is, the first complementary interlocking connection means is for engaging and interlocking with the second complementary interlocking connection means (and vice versa), in a complementary fashion (meaning having corresponding shapes and/or features for interlocking engagement), for releasably connecting the volute assembly and bearing housing together without the use of separate fasteners. (Although, separate fasteners may additionally be provided for further securing the volute assembly and bearing housing together.) In embodiments, the first and second complementary interlocking connection means comprise teeth and slots as described herein. In other embodiments, the first and second complementary interlocking connection means comprise threaded connectors as described above.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system for a rotary machine, comprising:

a volute assembly having a first connector configured to interlock with a second connector of a bearing housing, the first and second connectors configured to engage to a greater extent through relative rotation between the volute assembly and the bearing housing, the volute assembly including a first flange, the first flange having a first plurality of teeth extending radially from a perimeter of the first flange, the first plurality of teeth forming the first connector, the first plurality of teeth spaced only around a 270 degree range of the perimeter of the first flange, the first flange further including a plurality of fastener apertures positioned in a higher density within the 270 degree range of the perimeter of the first flange and positioned in a lower density outside of the 270 degree range.

2. The system of claim 1, wherein:

the bearing housing has a second flange, the second flange having a second plurality of teeth extending radially from a perimeter of the second flange, the second plurality of teeth forming the second connector, the second plurality of teeth spaced around a 270 degree range of the perimeter of the second flange; and the first plurality of teeth and the second plurality of teeth are configured to interlock for coupling the bearing housing and the volute assembly together.

3. The system of claim 2, wherein the plurality of fastener apertures of the first flange and an additional plurality of fastener apertures of the second flange are positioned in a complementary, radially symmetric configuration for further coupling the bearing housing and the volute assembly together with a plurality of fasteners.

4. The system of claim 2, wherein each tooth of the first plurality of teeth extends radially inward toward a turbocharger rotational axis defined by the volute assembly and bearing housing when connected, and each tooth of the second plurality of teeth extends radially outward away from the rotational axis.

5. The system of claim 4, wherein each tooth of the first plurality of teeth is spaced from the first flange by a connector which extends perpendicular to the first flange and couples each tooth of the first plurality of teeth to the first flange.

6. The system of claim 2, further comprising a first set of slots and a second set of slots, wherein each tooth of the first plurality of teeth is separated from an adjacent tooth of the first plurality of teeth by a respective slot of the first set of slots, and wherein each tooth of the second plurality of teeth is separated from an adjacent tooth of the second plurality of teeth by a respective slot of the second set of slots, wherein each tooth of the first plurality of teeth has a smaller width than each slot of the first set of slots, and wherein each tooth of the second plurality of teeth has a smaller width than each slot of the second set of slots.

7. The system of claim 6, wherein:

the volute assembly comprises a volute portion and the first flange connected to the volute portion, the volute portion being configured to channel intake air compressed by a compressor, and wherein the first flange is annular and coaxial with a turbocharger rotational axis defined by the volute assembly and bearing housing when connected; and the bearing housing is configured to house and support a turbocharger shaft to be coupled to the compressor and a turbine, and wherein the second flange is annular and coaxial with the turbocharger rotational axis.

8. The system of claim 2, wherein each tooth of the first plurality of teeth has a same first width and wherein each tooth of the second plurality of teeth has a same second width.

9. The system of claim 2, wherein the first plurality of teeth is configured to interlock with the second plurality of teeth at a volute assembly-bearing housing joint.

10. A turbocharger comprising:

the system of claim 9, wherein the bearing housing is coupled to the volute assembly by the first plurality of teeth being interlocked with the second plurality of teeth and further by a plurality of fasteners extending through the first flange and the second flange;

a shaft housed in and supported by the bearing housing;

a turbine connected to a first end of the shaft; and a compressor connected to a distal, second end of the shaft and in fluid communication with a volute portion of the volute assembly for compressing intake air for routing through the volute portion.

11. The turbocharger of claim 10, wherein the volute assembly-bearing housing joint is configured to prevent detachment of the bearing housing from the volute assembly when energy is applied internally to at least one of the volute assembly or the bearing housing by components of the compressor during a failure condition.

12. A rotary machine, comprising:

a volute assembly having a first flange with a first plurality of teeth extending radially inward from a perimeter of the first flange;

a bearing housing having a second flange with a second plurality of teeth extending radially outward from a perimeter of the second flange, and wherein the first plurality of teeth overlaps the second plurality of teeth to couple the volute assembly to the bearing housing at a volute assembly-bearing housing joint; and a plurality of fasteners configured to further couple the first flange to the second flange at the volute assembly-bearing housing joint, the plurality of fasteners positioned radially intermediate the perimeter of the first flange and a rotational axis of the rotary machine;

wherein each tooth of the first plurality of teeth is spaced from the first flange by a respective connector, which has a length corresponding to a thickness of each tooth of the second plurality of teeth, wherein the first plurality of teeth is spaced only around a 270 degree range of the perimeter of the first flange, the first flange further including a plurality of fastener apertures positioned in a higher density within the 270 degree range of the perimeter of the first flange and positioned in a lower density outside of the 270 degree range, each of the plurality of fastener apertures configured to receive a respective fastener of the plurality of fasteners.

13. The rotary machine of claim 12, wherein each tooth of the first plurality of teeth overlaps an entire length of a respective tooth of the second plurality of teeth.

14. The rotary machine of claim 12, wherein the plurality of fastener apertures of the first flange includes a first plurality of fastener apertures positioned radially around the first flange and the second flange further includes a second plurality of fastener apertures positioned radially around the second flange, and wherein each fastener of the plurality of fasteners passes through a respective fastener aperture of the first plurality of fastener apertures and a respective fastener aperture of the second plurality of fastener apertures.

* * * * *